US008207672B2

(12) United States Patent
Betsui et al.

(10) Patent No.: US 8,207,672 B2
(45) Date of Patent: Jun. 26, 2012

(54) PLASMA DISPLAY PANEL HAVING A DISCHARGE STABILIZER POWDER AND METHOD OF MANUFACTURING THE SAME

(75) Inventors: Keiichi Betsui, Yokohama (JP); Shinya Fukuta, Yokohama (JP); Tadayoshi Kosaka, Yokohama (JP); Minoru Hasegawa, Fujisawa (JP); Hajime Inoue, Yokohama (JP); Yoshiho Seo, Yokohama (JP); Tomonari Misawa, Yokohama (JP)

(73) Assignee: Hitachi, Ltd, Tokyo (JP)

( * ) Notice: Subject to any disclaimer, the term of this patent is extended or adjusted under 35 U.S.C. 154(b) by 124 days.

(21) Appl. No.: 12/674,131

(22) PCT Filed: Oct. 2, 2007

(86) PCT No.: PCT/JP2007/069300

§ 371 (c)(1),
(2), (4) Date: Mar. 15, 2010

(87) PCT Pub. No.: WO2009/044456

PCT Pub. Date: Apr. 9, 2009

(65) Prior Publication Data

US 2011/0001427 A1 Jan. 6, 2011

(51) Int. Cl.

| | |
|---|---|
| ***H01J 17/49*** | (2006.01) |
| ***H01J 9/00*** | (2006.01) |
| *H01J 9/24* | (2006.01) |

(52) U.S. Cl. ..... 313/586; 313/584; 313/585; 313/587; 315/169.1; 315/169.4; 445/24; 445/25

(58) Field of Classification Search ..... 313/581–587; 345/37, 41, 60, 71; 315/169.1, 169.4
See application file for complete search history.

(56) References Cited

U.S. PATENT DOCUMENTS

| | | | |
|---|---|---|---|
| 5,938,494 | A | 8/1999 | Betsui et al. |
| 2002/0074623 | A1 | 6/2002 | Sakurai et al. |
| 2005/0206318 | A1 | 9/2005 | Hirota et al. |
| 2007/0013306 | A1 | 1/2007 | Hai et al. |
| 2008/0049382 | A1 | 2/2008 | Kasahara |
| 2008/0278419 | A1 | 11/2008 | Misawa et al. |

FOREIGN PATENT DOCUMENTS

| | | | |
|---|---|---|---|
| JP | 10-149767 | A | 6/1998 |
| JP | 11-149865 | A | 6/1999 |
| JP | 2000-164136 | A | 6/2000 |
| JP | 3073451 | B2 | 6/2000 |
| JP | 2000-294153 | A | 10/2000 |
| JP | 2000-331601 | A | 11/2000 |

(Continued)

*Primary Examiner* — Tracie Y Green
(74) *Attorney, Agent, or Firm* — Miles & Stockbridge P.C.

(57) ABSTRACT

A technique for achieving both discharge voltage reduction and discharge stabilization in a PDP and the like is provided. This PDP manufacturing method includes, for a structure of a front plate structure (11) to be exposed to a discharge space (30) to be filled with a discharge gas, a step of forming a first layer (4) having an effect of discharge protective layer on a dielectric layer (3), a step of forming a second layer (5) for protecting the first layer on the first layer, and a step of forming a third layer (6) of a powder for discharge stabilization to be exposed to the discharge space (30), the steps being performed in vacuum manufacturing process. And, the structure is made such that a surface of the first layer is exposed to the discharge space (30) by a step of removing the second layer by an aging discharge in the discharge space (30).

6 Claims, 4 Drawing Sheets

FOREIGN PATENT DOCUMENTS

| | | | |
|---|---|---|---|
| JP | 2002-294432 | A | 10/2002 |
| JP | 2004-281276 | A | 10/2004 |
| JP | 2004-288454 | A | 10/2004 |
| JP | 2006-059780 | A | 3/2006 |
| JP | 2006-059786 | A | 3/2006 |
| JP | 2007-141483 | A | 6/2007 |
| JP | 2007-311075 | A | 11/2007 |
| JP | 2008-053012 | A | 3/2008 |
| JP | 2008-282623 | A | 11/2008 |
| JP | 2008-293803 | A | 12/2008 |

PLASMA DISPLAY PANEL HAVING A DISCHARGE STABILIZER POWDER AND METHOD OF MANUFACTURING THE SAME

TECHNICAL FIELD

The present invention relates to a display device such as a plasma display panel (PDP), and more particularly, it relates to a powder material (priming particle (electron) emitting powder) etc. for stabilizing discharge of the PDP.

BACKGROUND ART

For an alternate-current type PDP and a display device of the PDP, stabilization of discharge (discharges in a discharge space and display cell) in the PDP is an important technique. To stabilize the discharge, a PDP structure and a material by which discharge is fired at a further lower voltage and plenty of priming particles (electrons) are supplied to the discharge space are necessary.

As the PDP structure and material for the purpose, a film (layer) of magnesium oxide (MgO) has been conventionally used to a surface being in contact with (exposed) to discharge (discharge space).

For example, there is a structure in which a protective layer (discharge protective layer) of MgO is provided on a dielectric layer of a front plate structure in a PDP. Also, there is a structure in which a priming-particle-emitting powder (layer) of MgO crystal powder or the like is further provided on the protective layer.

While the above-mentioned MgO film is a material sufficiently working and effective, a material which outperforms MgO (effects of a discharge voltage reduction etc. by MgO) is needed to further improve display characteristics of PDPs.

As a material for the further improvement, strontium oxide (SrO), calcium oxide (CaO) and the like have been already found out as materials which lower the discharge voltage. However, films (low-discharge-voltage films) formed of these materials are unstable in the air, and thus they cannot be handled well as they are in the manufacturing process.

To handle the films of the above-mentioned materials such as SrO and CaO well, as described in Japanese Patent No. 3073451 (Patent Document 1), there has been suggested a method in which a surface of the film of any of these materials after deposition is covered with an inactive (inert) film (air barrier layer (temporary protective film)) so that reaction in the air (reaction with moisture, carbon-rich gas etc.) is suppressed (prevented), and the inactive film is removed after panel assembly.

In addition, the following is a supplementation to the above discharge stabilization (discharge delay improvement). Along with achievement of higher definition of the PDP, to shorten an address period, it is effective to reduce a width of an applied voltage pulse. However, there is a variation in the time (discharge delay) from application of a voltage (e.g., address voltage) to generation of a discharge (e.g., address discharge). Thus, when the width of the applied voltage pulse is small, there is a possibility that discharge may not be generated even the pulse is applied. In that case, as display cell are not turned ON properly, an image quality degradation will be posed. As a means for improving the above-mentioned discharge delay, there is a technique of providing MgO crystal (layer) as a priming-particle-emitting powder (layer) to be exposed to a discharge space in a front plate structure. Such a technique is described in, for example, Japanese Patent Application Laid-Open Publication No. 2006-59786 (Patent Document 2).

Patent Document 1: Japanese Patent No. 3073451

Patent Document 2: Japanese Patent Application Laid-Open Publication No. 2006-59786

DISCLOSURE OF THE INVENTION

Problems to be Solved by the Invention

The low-voltage discharge film described above has a problem that it is difficult to generate a stable discharge as supplement of priming particles (electrons) is lacking. In other words, for example, a structure, in which the above-mentioned discharge protective layer of SrO or CaO is provided, has a discharge voltage reduction effect, but has a problem that not much discharge stabilizing (discharge delay improving) effect is obtained than, for example, the structure in which a priming-particle-emitting powder (layer) is provided on a discharge protective layer of MgO.

The present invention has been made in view of the above problem, and a main preferred aim of the present invention is to provide a technique capable of achieving both a reduction or maintaining of the discharge voltage and discharge stabilization (discharge delay improvement) so that the display characteristics can be further improved than ever before.

Means for Solving the Problems

The typical ones of the inventions disclosed in the present application will be briefly described as follows. To achieve the above-mentioned preferred aim, a typical embodiment is, as the above-described configuration for achieving both discharge voltage reduction and discharge stabilization, a technique of a display device such as a PDP, in which a discharge protective layer (called a first layer to discriminate), a discharge stabilizer powder (called a third layer to discriminate), and so forth are provided to a plate structure to which electrode groups and dielectric layers and so forth are formed; and the embodiment has the following configuration.

The present embodiment is a configuration having a structure in which an air barrier layer (second layer) is formed to a surface of a low-voltage discharge protective film (discharge protective layer (first layer)) combined with a structure in which a discharge stabilizer powder (third layer) exposed to a discharge space is provided. In the present embodiment, in a PDP manufacturing process (in a vacuum environment not exposed to the air), the above-mentioned air barrier layer (called a second layer to discriminate) is formed on the discharge protective layer (first layer) on the dielectric layer in the plate structure, and the discharge stabilizer powder (third layer) is further formed on the second layer. A crystal-like material (material having a high crystallinity) having a high ability of supplying priming particles is used as the powder (third layer).

And, in a PDP manufacturing process, after panel assembly, exhaust, discharge-gas filling etc., the second layer (most part thereof) is removed. In this manner, the surfaces of the first layer and the third layer (powder) are exposed to the discharge space (discharge gas). Consequently, a state of a panel product is obtained.

In the PDP of the present embodiment, for example, SrO, CaO or a mixed substance of SrO and CaO is used as the first layer. As the second layer, MgO is used. As the third layer (powder), MgO crystal powder is used.

According to the above-described configuration (combination of three kinds of layers), basically, a discharge voltage reduction by the first layer, a suppression of reaction with air of the first layer, and discharge stabilization (usage of priming-particle supply) are achieved.

In addition, a PDP of another embodiment has a configuration in which an air barrier layer having the same function or formed of the same material as that of the second layer is further formed as a surface film to each surface of the powder particles with respect to the third layer (discharge stabilizer powder). Consequently, suppression of reaction with air of the third layer (powder) is also achieved.

A method of manufacturing a plasma display panel according to the embodiment includes, for a structure of a plate structure (front plate structure) on a side to be exposed to a discharge space (discharge surface) to which a discharge gas is filled, the steps of: forming a first layer having a discharge protection function on a dielectric layer without exposing to the air; forming a second layer for protecting the first layer from exposure to the air on the first layer; forming a third layer of a powder for discharge stabilization on the second layer such that the third layer is exposed to the discharge space, in vacuum manufacturing process. And, the present manufacturing method includes a step of forming a structure in which at least a part of the second layer is removed by an aging discharge in the discharge space and at least a part of a surface of the first layer is thus exposed to the discharge space from the second layer after the removal.

Effects of the Invention

The effects obtained by typical aspects of the present invention will be briefly described below. According to a typical embodiment, in a PDP and the like, by the configuration of the combination including the first layer and the third layer (and second layer), both effects of reduction or maintaining of the discharge voltage and discharge stabilization (discharge delay improvement) are achieved, thereby improving display characteristics more than ever before.

BRIEF DESCRIPTIONS OF THE DRAWINGS

Figure 5A:
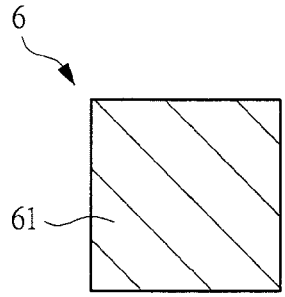
Figure 5B:
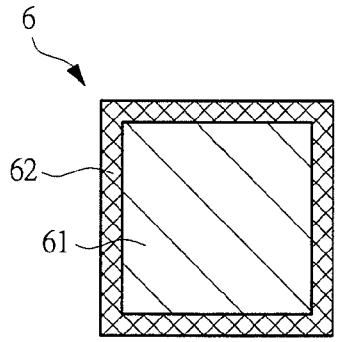
Figure 5C:
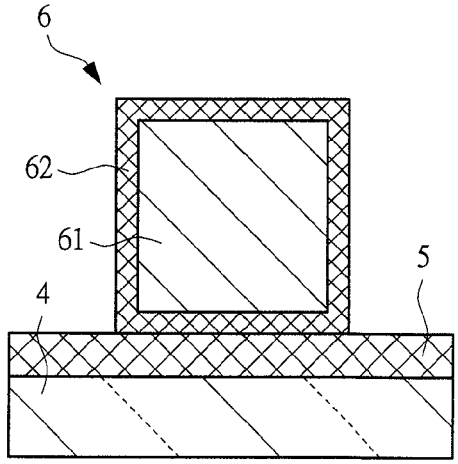
Figure 5D:
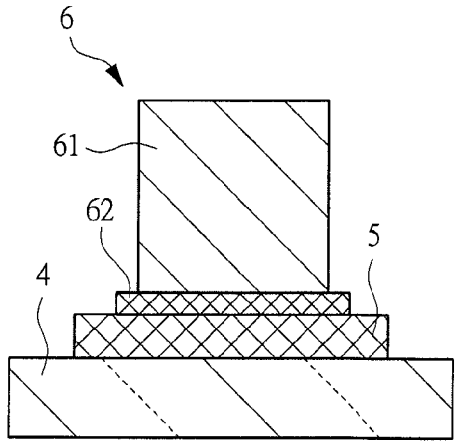

FIGS. 5A-5D are diagrams schematically illustrating cross-section configurations of a discharge stabilizer powder forming the third layer in the case of having a surface film (air barrier layer), FIG. 5A illustrating a state of an original powder, FIG. 5B illustrating a state of having the surface film formed to the powder, FIG. 5C illustrating a state of having the powder attached onto the second layer, and FIG. 5D illustrating a state of having the surface film of the powder being removed, respectively.

BEST MODE FOR CARRYING OUT THE INVENTION

Hereinafter, embodiments of the present invention will be described in detail with reference to the accompanying drawings. Note that components having the same function are denoted by the same reference symbols throughout the drawings for describing the embodiment, and the repetitive description thereof will be omitted.

<Outline>

An outline of a PDP and a method of manufacturing the PDP according to a present embodiment is as follows (note that the reference numerals correspond to those in the embodiments described later). Upon manufacturing the present PDP 10, in a front plate structure 11, a first layer (discharge protective layer 4), a second layer (air barrier layer 5), and a third layer (discharge stabilizer powder 6, in other words, priming-particle-emitting powder (layer)) are stacked in sequence onto a dielectric layer 3 covering a group of display electrodes 2 on a glass substrate 1. A panel (PDP 10) is assembled by combining the front plate structure 11 and a back plate structure 12, and discharge spaces 30 are formed by vacuum exhaust and discharge-gas filing to an internal space of the panel, and thus once a panel having a structure of having the second layer is fabricated. Thereafter, by a step of an aging discharge (initial discharge) in the discharge spaces 30 of the panel, the second layer (most part thereof) is removed, so that a structure in which a surface of the first layer and the powder of the third layer are exposed to the discharge spaces 30 is obtained. In this manner, a desired PDP 10 product is finished.

A material of the first layer (discharge protective layer 4) contains one or more kinds from BeO, MgO, CaO (calcium oxide), SrO (strontium oxide), and BaO which are oxides of alkaline-earth metals (including Be and Mg), alternatively, one or more kinds from $Li_2O$, $Na_2O$, $K_2O$, $Rb_2O$, and $Cs_2O$ which are oxides of alkali metals.

A material of the second layer (air barrier layer 5) can be used in the same way as the material described in Patent Document 1. That is, the material of the second layer contains one or more kinds from SiN, $SiO_2$, $Al_2O_3$, MgO, $TiO_2$, $MgF_2$, $CaF_2$, etc.

A material of the third layer (discharge stabilizer powder 6) contains a crystal powder (powder particles) of one or more kinds from BeO, MgO, CaO, SrO, and BaO which are alkaline-earth metals (including Be and Mg), alternatively, one or more kinds from $Li_2O$, $Na_2O$, $K_2O$, $Rb_2O$, and $Cs_2O$ which are oxides of alkali metals.

In the present embodiment, as the materials of the respective layers, the followings are particularly used. As the first layer, as a material having a higher discharge voltage reducing effect than that of MgO, a mixture of SrO and CaO is used and deposited. As the second layer on that, a MgO layer is deposited. As the third layer (powder 6) on that, a single-crystal MgO powder is attached.

As a method of forming the first layer, vapor deposition or the like can be used. As a method of forming the second layer, sequential vapor deposition or the like can be used. As a method of forming the third layer (powder 6), for example, a method of spreading (spraying) or applying a material containing the powder 6 onto the second layer or the like can be used.

According to the present configuration, a discharge voltage (a voltage applied for causing a discharge to occur in the discharge space 30 (display cell)) is reduced to about −30 V as compared with a conventional configuration, and also, discharge delay is also improved.

<Basic PDP Structure>

Figure 1:
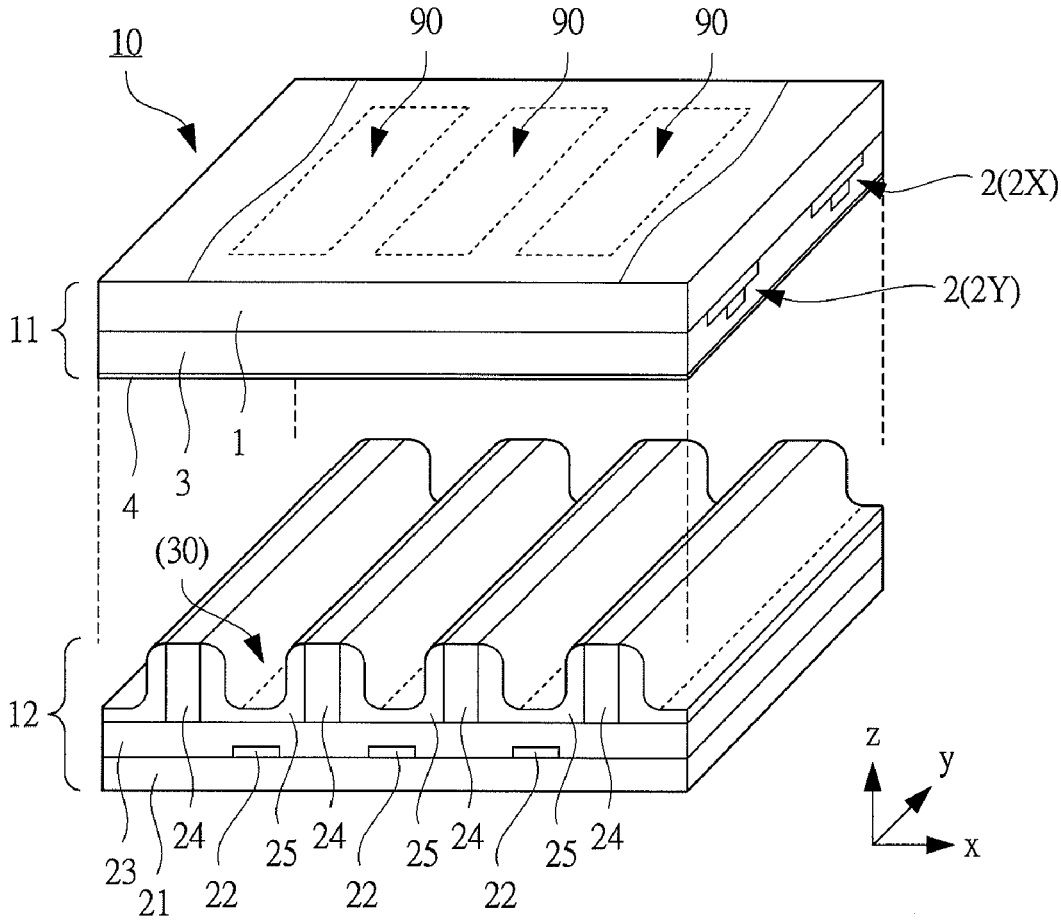
FIG. 1 is a diagram illustrating a basic structure example by an exploded perspective view enlarging a main part (pixel) of a PDP according to an embodiment of the present invention.

An example of a basic structure of the PDP (panel) 10 of the present embodiment is illustrated in FIG. 1. A part of a set of display cells (unit area 90) of respective colors corresponding to pixels is illustrated. Note that, for description, there are an x-direction (horizontal direction), a y-direction (vertical direction), and a z-direction (perpendicular direction to the panel surface).

The present PDP 10 is formed by combining the front plate structure 11 and the back plate structure 12, and the discharge spaces 30 (in FIG. 1, areas of grooves between barrier ribs 24 between the discharge protective layer 4 and a conductive layer 23) are formed by filling a discharge gas into the internal space between the front plate structure 11 and the back plate structure 12.

In the front plate structure 11, a group of display electrodes 2 (2X, 2Y) arranged repeatedly in the y-direction and extending in the x-direction on the glass substrate 1. The display electrodes 2 include a sustain electrode 2X for sustain operation and a scan electrode 2Y for sustain operation and scanning operation (used in both operations). The display electrodes configure a display line by a pair of the adjacent sustain electrode 2X and scan electrode 2Y. The electrode array configuration can be a normal configuration (a configuration in which the pair of display electrodes 2 is provided to be a non-discharge area (reverse slit)) or a so-called ALIS configuration (a configuration in which the display lines are configured by all the adjacent pairs of display electrodes 2).

The group of display electrodes 2 on the glass substrate 1 is covered with the dielectric layer 3. On the dielectric layer 3, the discharge protective layer 4 is further formed. The dielectric layer 3 and the discharge protective layer 4 are formed over the entire surface corresponding to a display area (screen) of the PDP 10.

In the back plate structure 12, a group of address electrodes 22 is arranged in the y-direction crossing the display electrodes 2 on a glass substrate 21. A display cell is formed corresponding to a crossing part of the sustain electrode 2X, scan electrode 2Y, and address electrode 22. The group of address electrodes 22 is covered with the dielectric layer 23. On the dielectric layer 23, the barrier ribs 24 are formed in stripe extending in, for example, the y-direction at positions between the address electrodes 22. Note that the barrier ribs 24 section the discharge spaces 30 corresponding to the unit areas 90 (display cells). Above the address electrodes 22 and in the areas sectioned by the barrier ribs 24, a phosphor 25 of each color of R (red), G (green), and B (blue) is formed in sequence in a different color per display column.

Upon driving the PDP 10, in an address period, a voltage is applied across the address electrode 22 and the scan electrode 2Y to generate a discharge (address discharge) in selected display cells. And, in a sustain period, a voltage is applied across the pair of display electrodes 2 (2X, 2Y) to generate a discharge (sustain discharge) in selected display cells. By these operations, emission (turn-ON) at desired display cells in a subfield is performed. In addition, by selecting a subfield to turn ON in a field, luminance of pixels (display cells) is expressed.

<PDP Manufacturing Method>

Figure 2:
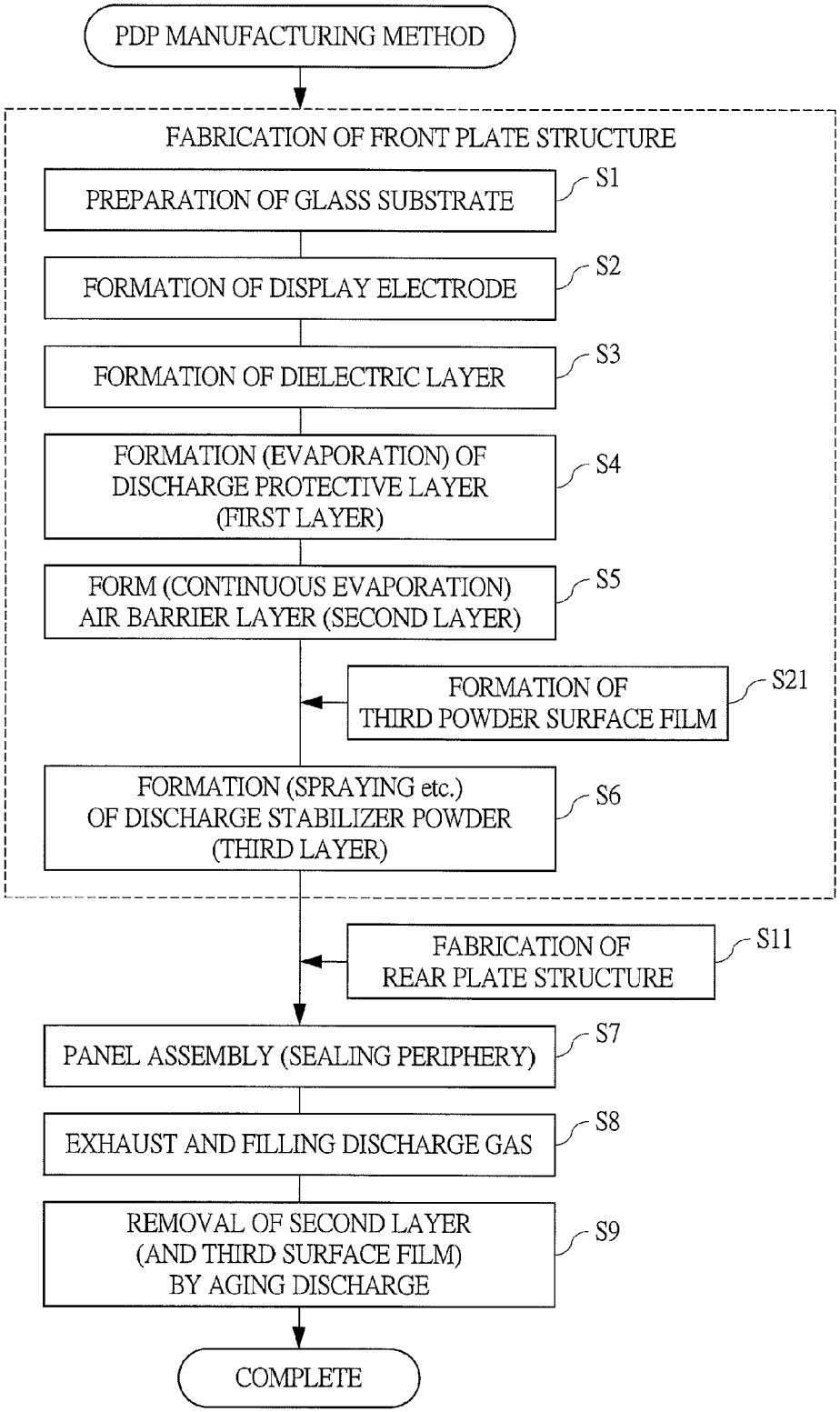
FIG. 2 is a diagram illustrating a summary of a basic manufacturing flow of a method of manufacturing the PDP according to the embodiment of the present invention.

An outline of a method of manufacturing the PDP 10 (common in first and second embodiments) according to the present embodiment is illustrated in FIG. 2 (S means a step). Steps of fabricating the front plate structure 11 (S1 to S6), a step of fabricating the back plate structure 12, and steps from panel assembly to finish (S7 to S9) are included.

First, in the fabrication of the front plate structure 11, the glass substrate 1 is prepared in S1. Transparent materials such as glass can be used for the glass substrate 1. In S2, the group of display electrodes 2 (2X, 2Y) is formed on the glass substrate 1 with using screen printing or photolithography plus etching, etc.

In S3, the dielectric layer 3 is formed to cover the group of display electrodes 2 on the glass substrate 1. The dielectric layer 3 formed by, for example, applying a low-melting-point glass paste by screen printing or the like, and baking.

In S4, the discharge protective layer 4 (first layer) is formed on the dielectric layer 3 by, for example, vapor deposition (alternatively, sputtering or application can be used).

In S5, the air barrier layer 5 (second layer) is formed on the discharge protective layer 4 (first layer) by, for example, sequential vapor deposition to the first layer.

In S6, the discharge stabilizer powder 6 (third layer) is formed on the air barrier layer 5 (second layer) by, for example, spreading of a slurry (powder-containing material) and drying.

Note that, in the case of a second embodiment described later, a surface film (air barrier layer 62) of the discharge stabilizer powder 6 (third layer) is formed in S21, and then the powder 6 is used in S6.

Note that S4 to S6 are manufacturing steps in vacuum (vacuum chamber) without exposure to the air.

Meanwhile, in S11, the back plate structure 12 is fabricated with using a known technique in, for example, the following manner. The glass substrate 21, address electrode 22, dielectric layer 23 etc. can be formed in the same manner as the front side. The barrier ribs 24 are formed by forming a layer of a material such as a low-melting-point glass paste and patterning it by sandblast or the like, and then baking it. The phosphor 25 is formed by applying a phosphor paste to an area between the barrier ribs 24 to R, B, G, respectively, by screen printing or dispenser, and baking.

Next, in S7, the fabricated front plate structure 11 and back plate structure 12 are combined facing each other, so that the panel (PDP 10) is assembled. That is, the part between the front plate structure 11 and the back plate structure 12 and the periphery are attached by an adhesive (low-melting-point glass or the like) and subjected to a thermal processing to be sealed.

In S8, to the internal space of the panel, vacuum exhaust and discharge-gas filling are performed through a tip-off tube connected externally, and the tip-off tube is sealed and cut, so that the discharge spaces 30 are configured. In this manner, once the state of a panel having the structure including the second layer is obtained.

In S9, by an aging discharge (initial discharge) in the discharge spaces 30 caused by a voltage application to the electrodes (2X, 2Y, 22) of the panel, most part of the second layer (and, a surface film of the third layer in the second embodiment) is removed. In this manner, a surface of the first layer and the powder 6 of the third layer are exposed to the discharge spaces 30 and the panel product is completed.

(First Embodiment)

Based on the foregoing, the PDP 10 etc. (the discharge stabilizer powder 6 etc.) and a method of manufacturing the PDP of a first embodiment which is a more detailed embodiment will be described with reference to FIGS. 1 to 3.

Figure 3:
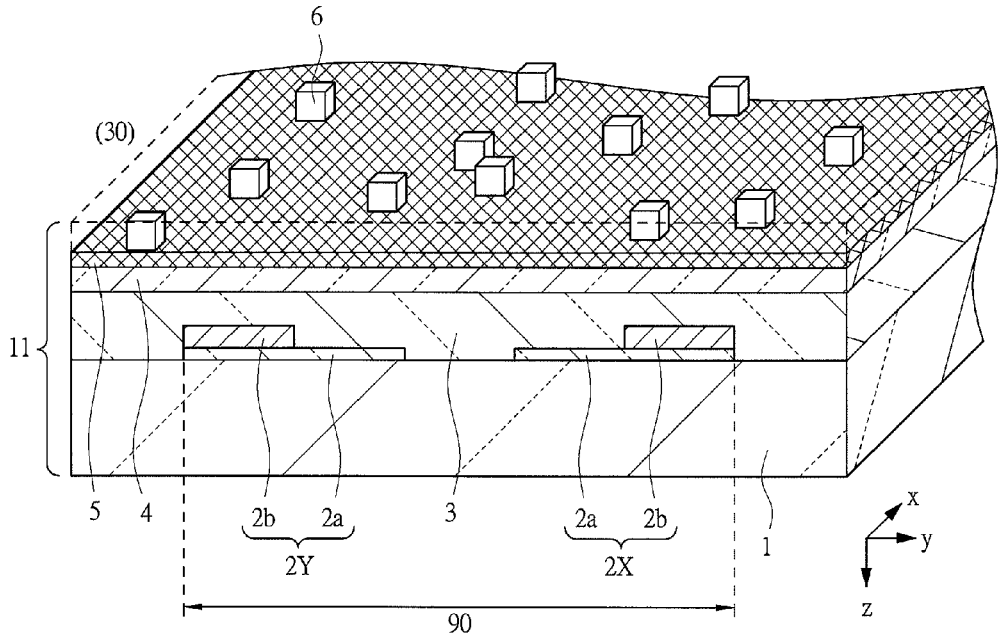
FIG. 3 is a diagram schematically illustrating, in a perspective manner, a cross-section (y-z) and a configuration of a surface exposed to a discharge space of a discharge cell part in a front plate structure including a first layer, second layer, and third layer in vacuum manufacturing process of a PDP according to a first embodiment of the present invention.

In FIG. 3, a cross-section (y-z) of the part of the discharge cells (unit areas 90) of the front plate structure 11 and a configuration of the surface (discharge surface) exposed to the discharge spaces 30 in vacuum manufacturing process is schematically illustrated. Hereinafter, the structure of the front plate structure 11 will be descried in the order of the manufacturing process (FIG. 2) (note that S21 is unnecessary in the first embodiment).

The display electrodes 2 (2X, 2Y) are formed on the glass substrate 1 (S1, S2). The display electrodes 2 (2X, 2Y) are configured by a transparent electrode 2*a* of ITO or the like having a large width and forming a discharge gap, and a bus electrode 2*b* of, for example, a three-layer structure of Cr/Cu/Cr having a small width and lowering the electrode resistance. Note that a normal configuration in employed in the electrode array configuration in FIG. 3.

Then, the dielectric layer 3 is formed to cover the display electrodes 2 on the glass substrate 1 (S3). As the dielectric layer 3, for example, a layer of a low-melting-point glass is formed to have a thickness of 20 μm.

The first layer (discharge protective layer 4) is formed on the dielectric layer 3 (S4). As the first layer, a layer of a eutectic (mixed crystal) of SrO and CaO (expressed by (Sr, Ca)O) is deposited. This (Sr, Ca)O layer is formed to have a thickness of 1 μm by vacuum vapor deposition (performed in a vacuum chamber). Allocation of Sr (SrO) and Ca (CaO) is, for example, 50% each. The discharge protective layer 4 has a function of protecting the dielectric layer 3 (sputter resistance) and secondary-electron emission, etc.

Subsequent to the formation of the first layer, the second layer (air barrier layer 5) is formed on a surface of the first layer (S5). As the second layer, a MgO layer is formed to have a thickness of 0.1 μm by vapor deposition in the same way. The second layer (MgO layer) is formed of a material having a stable property in the air, and it is a layer for temporally protecting (suppressing reaction with air) the first layer, that is, upon air exposure.

After taking out the substrate (front plate structure 11) from the vacuum chamber, the third layer (discharge stabilizer powder 6) is formed on a surface of the second layer (S6). The third layer (powder 6) is a priming-electron-emitting powder (layer), in other words. As a discharge stabilizing material for the third layer, particularly, single crystal MgO powder (particle) is used. Note that, the material to be used is not limited to single crystal (polycrystalline, aggregation substance, etc.).

With the powder 6 (MgO crystal), a discharge delay improving effect can be obtained by the function of emitting (supplying) priming particles (electrons) to the discharge space 30. Note that details of this function has not been particularly revealed, but it has been presumed that priming particles (electrons) are emitted (supplied) to the discharge space 30 from the powder 6 (MgO crystal) along discharge and react with particles in the discharge space 30.

The powder 6 is attached by spreading onto a subject surface (second layer surface). For example, a slurry (discharge stabilizer powder containing material) made by mixing and dispersing the powder 6 (single crystal MgO powder) in a powdery state in a solvent (IPA etc.) is prepared. And, the slurry is arranged (attached) onto the subject surface in a sheet-like and film-like manner by spreading with a painting spray gun or the like. Then, the film portion (slurry) is dried by heating and so forth to remove the solvent component and the powder 6 component is fixed onto the subject surface. Other than the slurry spreading method, a paste application method can be used. In the above manner, front plate structure 11 is formed.

Note that, in the third layer (powder 6), the powder 6 (crystal) (illustrated by a cube) is distributed sparsely and densely with respect to the subject surface (second layer surface). In the present embodiment, the situation where the powder 6 is sparsely distributed is schematically illustrated. Note that even when the powder is distributed sparsely, it is called a layer (film).

Thereafter, the front plate structure 11 and the back plate structure 12 are combined and their periphery is sealed, so that the panel is assembled (S7). Then, after vacuum exhaust, a heating degassing process is performed and filling of a discharge gas (e.g., Xe 10%, Ne 90%) at 450 Torr pressure (S8) performed to the internal space of the panel.

Thereafter, most part of the second layer is removed by an aging discharge (S9). In this step, an alternate voltage is applied to the pair of display electrodes 2 to generate a discharge in the discharge space 30. By this discharge, the surface of the second layer (MgO layer) is sputter-etched (plasma-etched), thereby removing the MgO. Confirmation about whether MgO is removed or not can be determined by monitoring the reduced amount of the discharge voltage.

Figure 4:
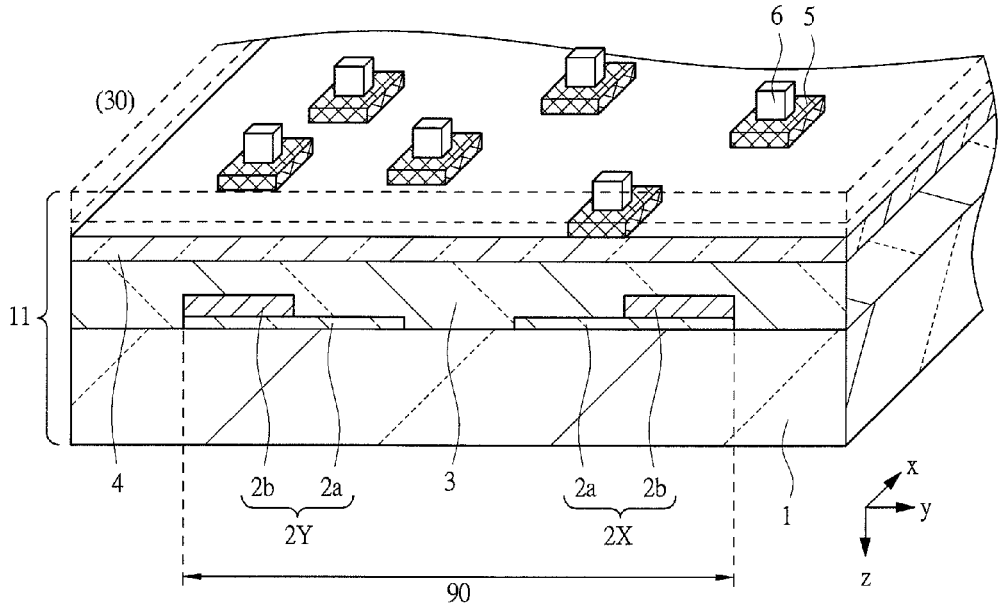
FIG. 4 is a diagram schematically illustrating, in a perspective way, a cross-section (y-z) and a configuration of the surface exposed to the discharge space of the discharge cell part in the front plate structure in a state (as panel product) of having the second layer (most part thereof) removed of the PDP according to the first embodiment of the present invention.

By the above-described step of the aging discharge (S9), the front plate structure 11 becomes the state of FIG. 4 (at panel manufacture). In the second layer, a part of it, i.e., the part to which the powder 6 is attached (under and around the powder 6) remains without being removed by the sputter etching (there is no problem functionally). And, most part of the second layer other than that part is removed, thereby exposing the first layer surface. That is, both of the first layer and the powder 6 of the third layer are exposed to the discharge space 30, thereby obtaining a designed functional layer.

The PDP 10 of the first embodiment fabricated in the above-described manner has a discharge voltage being −20 V lower (to be about −30 V) as compared with the conventional panel having a discharge protective layer of MgO alone. Also, as the discharge delay time indicating characteristics (effects) of the discharge stabilization becomes shorter than or equal to 0.5μ seconds, a panel operating at a sufficiently high speed is achieved. Note that a discharge delay time indicating characteristics (effects) of the discharge stabilization posed by the existence of the third layer can be measured and diagnosed by, for example, applying a voltage waveform for testing as a known technique.

(Second Embodiment)

With reference to FIG. 5, a PDP 10 and a method of manufacturing the PDP according to a second embodiment will be described. A configuration of parts of the second embodiment different from the first embodiment is as follows. While the case of using single crystal MgO as the discharge stabilizer powder 6 (the third layer) has been described in the first embodiment, other than that, single crystal SrO and single crystal CaO also function as the material (note that it is not limited to using single crystals). Powder of these materials are prone to react with moisture ($H_2O$) and carbon dioxide ($CO_2$) same as the case of using as the material of the discharge protective layer 4 (the first layer) (the first embodiment), and due to the reaction, a film (reacted layer) of hydroxide and carbonation product is formed on the surface of crystal of the powder.

In the second embodiment, also regarding the crystal (single crystal SrO, single crystal CaO) of the above-described discharge stabilizer powder 6 forming the third layer, the structure is such that the crystal surface is covered with a material having a stable property in the air, that is, a material similar to the second layer. In this manner, the reaction between the powder 6 of the third layer and the air is suppressed, thereby preventing formation of the reacted layer.

A material of a surface film (air barrier layer) 62 of the powder 6 can be selected from magnesium (Mg), silicon (Si), aluminum (Al), titanium (Ti), yttrium (Y), zirconium (Zr), tantalum (Ta), zinc (Zn), cobalt (Co), manganese (Mn), and lanthanum (La).

In the cross-sectional structures of the discharge stabilizer powder 6 illustrated in FIGS. 5A-5D, a powder 61 portion to be a core and the surface film (air barrier layer) 62 portion of the powder 61 portion are included. FIG. 5A is the original (unprocessed) discharge stabilizer powder 6, and for example, it is above-mentioned single crystal SrO or single crystal CaO. FIG. 5B is the discharge stabilizer powder 6 after being processed, and it is a double-layer structure having the surface film (air barrier layer) 62 formed around the powder 61 to be a core. As the surface film (air barrier film) 62, specifically, MgO or $SiO_2$ is used. As a method of forming the surface film 62, for example, the surface film 62 is grown to be attached on the powder 6 (61) by CVD (chemical vapor deposition). Note that the method of forming the surface film 62 and the structure of the powder 6 can be seen as a configuration in which the surface film 62 is stacked on the surface of the powder 6 (61) or a configuration in which the surface portion of the powder 6 (61) is changed to be the surface film 62.

In FIG. 5C, the powder 6 with the surface film 62 fabricated in the above manner is attached onto the second layer so that the third layer is formed. And, as illustrated in FIG. 5D, the air barrier layer, i.e., the second layer (air barrier layer 5) and the surface film 62 of the powder 6 of the third layer can be removed by sputter etching by the aging discharge (S9). According to the removal, in the panel product state, the surface of the powder 6 (61) of the third layer can be exposed as a clean crystal face.

According to the PDP 10 of the second embodiment fabricated in the above-described manner, in addition to the effects same as those of the first embodiment, an effect of suppressing reaction with the air can be also obtained by the discharge stabilizer powder 6 (priming-particle-emitting powder (layer)).

In the foregoing, the invention made by the inventors of the present invention has been concretely described based on the embodiments. However, it is needless to say that the present invention is not limited to the foregoing embodiments and various modifications and alterations can be made within the scope of the present invention.

INDUSTRIAL APPLICABILITY

The present invention is applicable to display devices such as a PDP.

The invention claimed is:

1. A plasma display panel, comprising, in a structure of a plate structure on a side exposed to a discharge space filled with discharge gas:

a first layer formed on a dielectric layer and having a discharge protection function;

a second layer formed on the first layer to protect the first layer from exposure to air; and a third layer of a powder formed on the second layer for discharge stabilization, the third layer being exposed to the discharge space, wherein the first, second, and third layers are formed in a vacuum manufacturing process, wherein, upon the vacuum manufacturing process, the powder of the third layer has a layer of a material having a low reactive property with respect to components of air that is formed so as to cover a powder core of the third layer, the powder core containing at least one crystal powder selected from CaO, and SrO, and wherein at least a part of the second layer and at least a part of the low reactive layer are removed by an aging discharge such that portions of the first layer, the second layer, the third layer and the powder core are exposed to the discharge space.

2. The plasma display panel according to claim 1, wherein a material of the first layer is a metal oxide containing at least one selected from CaO, BeO, SrO, and BaO.

3. The plasma display panel according to claim 1, wherein the second layer is an MgO layer having a thickness of 0.1 μm formed by vapor deposition.

4. The plasma display panel according to claim 1, wherein the low reactive layer contains at least one selected from Mg, Si, Al, Ti, Y, Zr, Ta, Zn, Co, Mn, and La.

5. A method of manufacturing a plasma display panel comprising, as steps of forming a structure of a plate structure on a side exposed to a discharge space to which a discharge gas is filled, the steps of:

in a vacuum manufacturing process:

forming a first layer having a discharge protection function on a dielectric layer;

forming a second layer on the first layer for protecting the first layer from exposure to air;

forming a third layer of a powder on the second layer for discharge stabilization such that the third layer is exposed to the discharge space; and after said vacuum manufacturing process, removing at least a part of the second layer in the discharge space by an aging discharge process to form a structure in which at least a part of a surface of the first layer is exposed to the discharge space from a part where the second layer is removed, wherein the powder of the third layer has a structure having a powder core and a layer of a material having a low reactive property to air covering a surface of the powder core, wherein the powder core includes at least one crystal powder selected from CaO and SrO, and wherein, by the aging discharge process, at least a part of the low reactive layer is removed so as to expose a portion of the powder core to the discharge space.

6. The method of manufacturing a plasma display panel according to claim 5, wherein the second layer is an MgO layer having a thickness of 0.1 μm formed by vapor deposition.

* * * * *